US008411882B2

(12) United States Patent
Lee et al.

(10) Patent No.: US 8,411,882 B2
(45) Date of Patent: Apr. 2, 2013

(54) ELECTRONIC DEVICE WITH ELECTRET ELECTRO-ACOUSTIC TRANSDUCER

(75) Inventors: Fang Ching Lee, Taoyuan (TW); Yi Tsung Cheng, Taoyuan (TW); Chih Chao Hsieh, Taoyuan (TW)

(73) Assignee: HTC Corporation, Taoyuan (TW)

( * ) Notice: Subject to any disclaimer, the term of this patent is extended or adjusted under 35 U.S.C. 154(b) by 545 days.

(21) Appl. No.: 12/560,132

(22) Filed: Sep. 15, 2009

(65) Prior Publication Data

US 2010/0111335 A1 May 6, 2010

(30) Foreign Application Priority Data

Oct. 31, 2008 (TW) ..... 097141921 A

(51) Int. Cl.
*H04R 25/00* (2006.01)

(52) U.S. Cl. ..... 381/191; 381/396; 381/398; 381/399

(58) Field of Classification Search ..... 381/191, 381/150, 396, 398, 399
See application file for complete search history.

(56) References Cited

U.S. PATENT DOCUMENTS

| | | | | |
|---|---|---|---|---|
| 3,084,229 | A | 4/1963 | Selsted et al. | |
| 3,711,941 | A | 1/1973 | Sessler et al. | |
| 3,935,397 | A | 1/1976 | West | |
| 3,980,838 | A | 9/1976 | Yakushiji et al. | |
| 4,041,446 | A | 8/1977 | Liebermann | |
| 4,160,882 | A | 7/1979 | Driver | |
| 5,247,490 | A | 9/1993 | Goepel et al. | |
| 6,496,586 | B1 | 12/2002 | Hayes et al. | |
| 6,806,593 | B2 | 10/2004 | Tai et al. | |
| 7,091,650 | B2 | 8/2006 | Xu et al. | |
| 7,329,933 | B2 | 2/2008 | Zhe et al. | |
| 7,583,811 | B2 | 9/2009 | Wada | |
| 2001/0004398 | A1 * | 6/2001 | Omata et al. | 381/386 |
| 2002/0170772 | A1 | 11/2002 | Asahina et al. | |
| 2004/0062406 | A1 | 4/2004 | Sakamoto | |
| 2004/0170291 | A1 | 9/2004 | Eaton | |
| 2005/0122043 | A1 | 6/2005 | Kato et al. | |
| 2005/0254673 | A1 | 11/2005 | Hsieh et al. | |
| 2006/0205244 | A1 | 9/2006 | Shigeno et al. | |
| 2007/0029899 | A1 | 2/2007 | Matsuzawa | |

(Continued)

FOREIGN PATENT DOCUMENTS

| | | | |
|---|---|---|---|
| CN | 1653850 | A | 8/2005 |
| CN | 2829267 | Y | 10/2006 |

(Continued)

OTHER PUBLICATIONS

European Communication for Application No. 09 169 282.2 mailed Sep. 27, 2012.

*Primary Examiner* — Davetta W Goins
*Assistant Examiner* — Jasmine Pritchard

(57) ABSTRACT

An electronic device is provided. The electronic device includes a housing and an electro-acoustic transducer disposed on the inner surface of the housing. The electro-acoustic transducer includes an electret diaphragm, a conductive plate and at least one spacer. The electret diaphragm is positioned on the inner surface of the housing and has a film body and an electrode layer. The film body has static charges and the electrode layer is formed on the lower surface of the film body. The conductive plate has a plurality of openings and is stacked on the upper surface of the film body. The spacer is positioned between the electret diaphragm and the conductive plate to keep a predetermined distance therebetween.

30 Claims, 5 Drawing Sheets

U.S. PATENT DOCUMENTS

| | | | | |
|---|---|---|---|---|
| 2008/0123876 | A1 | 5/2008 | Sato et al. | |
| 2008/0232088 | A1 | 9/2008 | Hente | |
| 2009/0030234 | A1* | 1/2009 | van Laar et al. | 564/408 |
| 2009/0039763 | A1 | 2/2009 | Chien et al. | |
| 2009/0060233 | A1 | 3/2009 | Liou et al. | |
| 2009/0060234 | A1* | 3/2009 | Liou et al. | 381/191 |
| 2011/0255721 | A1* | 10/2011 | Chen et al. | 381/191 |

FOREIGN PATENT DOCUMENTS

| | | | |
|---|---|---|---|
| EP | 0810676 | A1 | 12/1997 |
| EP | 1722596 | A1 | 11/2006 |
| GB | 2343811 | A | 5/2000 |
| JP | 51027318 | A | 3/1976 |
| JP | 536637 | | 1/1978 |
| JP | 10191496 | A | 7/1998 |
| JP | 2004166262 | A | 6/2004 |
| JP | 2004328055 | | 11/2004 |
| JP | 2007006459 | A | 1/2007 |
| JP | 2007110382 | A | 4/2007 |
| JP | 2008005439 | A | 1/2008 |
| TW | I293233 | | 12/1994 |
| TW | I294250 | | 12/1994 |
| WO | 0027166 | A2 | 5/2000 |
| WO | 2004062318 | A1 | 7/2004 |
| WO | 2006118680 | A1 | 11/2006 |
| WO | 2007023409 | A2 | 3/2007 |
| WO | 2008035878 | A1 | 3/2008 |

* cited by examiner

ELECTRONIC DEVICE WITH ELECTRET ELECTRO-ACOUSTIC TRANSDUCER

CROSS REFERENCE TO RELATED APPLICATION

This application claims the priority benefit of Taiwan Patent Application Serial Number 097141921 filed Oct. 31, 2008, the full disclosure of which is incorporated herein by reference.

BACKGROUND OF THE INVENTION

1. Field of the Invention

The invention relates to an electronic device with an electro-acoustic transducer, and more particularly, to an electronic device with an electret electro-acoustic transducer 2. Description of the Related Art Loudspeakers are a kind of device to make sound. The principle of making sound for the loudspeakers is to move the diaphragms thereof by electrical signals to push the air. Nowadays, the loudspeakers have been broadly used in electronic devices with the function of making sound, such as mobile phones, personal digital assistants (PDAs) and laptop computers.

One of the common loudspeakers is so-called dynamic loudspeaker. The principle of making sound for the dynamic loudspeaker is to drive a current through the voice coil to produce a magnet field. This magnetic field causes the voice coil to react to the magnetic field from a permanent magnet fixed to the frame of the loudspeaker thereby moving the diaphragm attached with the voice coil. Although such dynamic loudspeaker can provide very good quality of sound, the loudspeaker has a considerable thickness because its sound chamber is large. When such dynamic loudspeakers are used in the above-mentioned portable electronic devices, the thickness of these electronic devices cannot be reduced.

SUMMARY OF THE INVENTION

An electronic device with an electret electro-acoustic transducer according to the present invention is provided. The electret electro-acoustic transducers of the electronic devices have a greatly smaller thickness than the traditional dynamic loudspeakers. Therefore, the available space inside the electronic device can be increased.

In the first embodiment, the electronic device with an electro-acoustic transducer of the present invention includes a housing having a plurality of openings penetrating between the inner surface and the outer surface thereof. An electro-acoustic transducer is disposed on the inner surface of the housing. The electro-acoustic transducer includes a first electret diaphragm positioned on the inner surface of the housing. The first electret diaphragm includes a first film body and a first electrode layer formed on the lower surface of the first film body. The first film body is made of dielectric material and has static charges. A first conductive plate as an electrode is stacked on the upper surface of the first film body and has a plurality of openings. In addition, at least one first spacer is disposed between the first electret diaphragm and the first conductive plate to keep a predetermined distance therebetween.

In the second embodiment, the electronic device with an electro-acoustic transducer further includes a second conductive plate functioning as an electrode as compared with the electronic device of the first embodiment. The second conductive plate is stacked on the first conductive plate and has a plurality of openings. An isolation layer made of porous air-permeable membrane is disposed between first and second conductive plates. In addition, a second electret diaphragm is positioned on the second conductive plate and includes a second film body and a second electrode layer formed on the upper surface of the second film body. The second film body is made of dielectric material and has static charges. A sound absorbing layer is attached to the second electrode layer. Furthermore, at least one second spacer is disposed between the second electret diaphragm and second conductive plate to keep a predetermined distance therebetween.

In the third embodiment, the electronic device with an electro-acoustic transducer of the present invention includes a housing having a plurality of openings penetrating between the inner surface and the outer surface thereof. An electro-acoustic transducer is disposed on the inner surface of the housing. The electro-acoustic transducer includes a conductive plate as an electrode that is disposed on the inner surface of the housing and has a plurality of openings. An electret diaphragm is stacked on the conductive plate and includes a film body and an electrode layer formed on the upper surface of the film body. The film body is made of dielectric material and has static charges. In addition, at least one spacer is disposed between the electret diaphragm and conductive plate to keep a predetermined distance therebetween. A sound absorbing layer is attached to the electrode layer.

In the fourth embodiment, the electronic device with an electro-acoustic transducer is substantially the same as the electronic device of the third embodiment. The difference between them is in that the electro-acoustic transducer of the electronic device in this embodiment includes a conductive layer coated on the inner surface of the housing to replace the conductive plate of the third embodiment.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
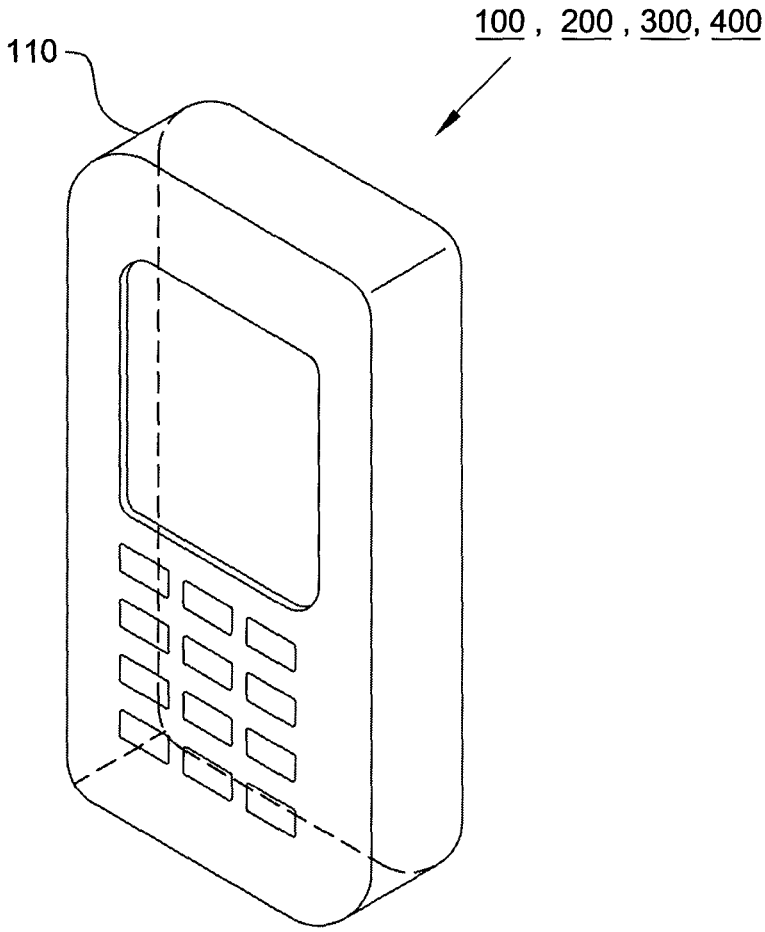
FIG. 1 is a perspective view of the electronic device of the present invention.
Figure 2A:
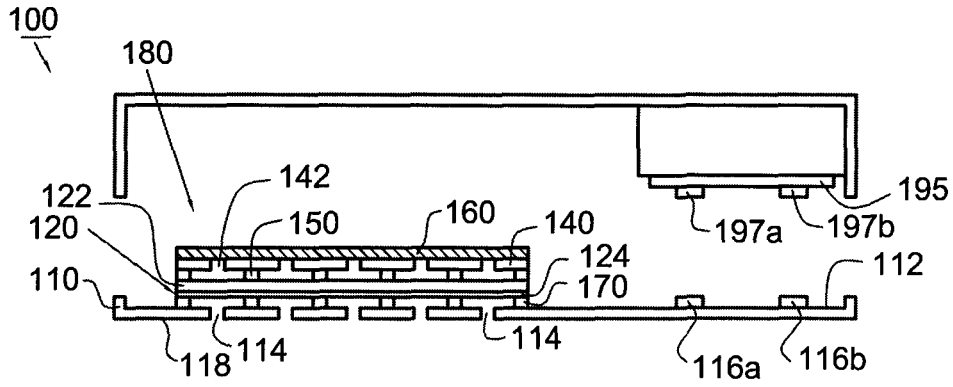
FIG. 2*a* is a cross-sectional view of the electronic device with an electro-acoustic transducer according to the first embodiment of the present invention, wherein the back cover is separated from the body of the electronic device.
Figure 2B:
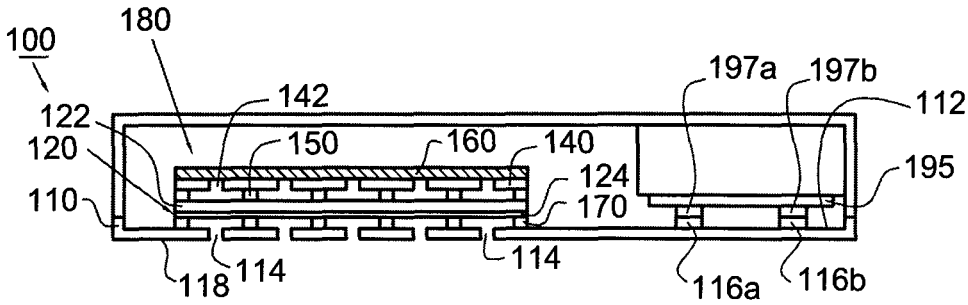
FIG. 2*b* is a cross-sectional view of the electronic device with an electro-acoustic transducer according to the first embodiment of the present invention, wherein the back cover is attached to the body of the electronic device.

Referring to FIGS. 1, 2*a* and 2*b*, the electronic device 100 with an electro-acoustic transducer according to the first embodiment of the present invention includes a housing 110 having a plurality of openings 114 penetrating between the inner surface 112 and the outer surface 118 thereof. An electro-acoustic transducer 180 is disposed on the inner surface 112 of the housing 110. The electro-acoustic transducer 180 includes an electret diaphragm 120 positioned on the inner surface 112 of the housing 110. In addition, the electret diaphragm 120 includes a film body 122 and an electrode layer 124 formed on the lower surface of the film body 122. The film body 122 is made of dielectric material and has static charges. The film body 122 has a thickness of 7 to 25 μm and the electrode layer 124 has a thickness of 0.05 to 1 μm. A conductive plate 140 functioning as an electrode is stacked on the upper surface of the film body 122 and has a plurality of openings 142 corresponding to the openings 114. The conductive plate 140 has a thickness of 0.1 to 1 mm, and an aperture ratio of the openings 142 on the conductive plate 140 is greater than 20%. Furthermore, at least one spacer 150 is disposed between the electret diaphragm 120 and the conductive plate 140 to keep a predetermined distance between the electret diaphragm 120 and the conductive plate 140. The spacer 150 is spaced 5 to 20 mm apart from each other and has a height of 100 to 400 μm.

In order to make the film body 122 carry static charges, the film body 122 originally without static charges carried thereon is required to be subjected to a polarizing process. For example, a corona charging process can be used to polarize the film body 122 to generate static charges therein and thereon after the electrode layer 124 is formed on the film body 122. The material suitable for the film body 122 can be fluorinated ethylene propylene (FEP), Polytetrafluoroethene (PTFE), Polyvinylidene Fluoride (PVDF), silicon dioxide (SiO2) or other fluoride polymers. Furthermore, the edge of the electret diaphragm 120 is required to be fixed to prevent the electret diaphragm 120 from movement. To have the electro-acoustic transducer 180 of the present embodiment work, electrical signals having the same phase and opposite phase with the original sound signal, i.e. differential signals have to be applied to the conductive plate 140 and electrode layer 124, respectively so that the electret diaphragm 120 is subject to the Coulomb forces from the conductive plate 140 and electrode layer 124 to bring about a push-pull effect. The push-pull effect will cause the electret diaphragm 120 to vibrate in accordance with the electrical signals. The vibration of the electret diaphragm 120 pushes the air to make sounds. The sounds can travel through the openings 114 to the outside of the housing 110 thereby a user can hear the sounds.

In addition, since the sounds made by the electret diaphragm 120 can also travel through the openings 142 of the conductive plate 140 and be bounced back by the elements above the conductive plate 140, the upper surface of the conductive plate 140 is spaced a predetermined distance, said more that 1 mm apart from the elements above the conductive plate 140 to prevent the echo from degrading the performance of the electro-acoustic transducer 180. Alternatively, a sound absorbing layer 160 made of, such as glass fiber, sponge or nonwoven can be attached to the upper surface of the conductive plate 140 to absorb the sounds traveling through the openings 142. The sound absorbing layer 160 has a thickness of 1 to 5 mm. Moreover, at least one spacer 170 with a thickness of 30 to 50 μm and corresponding to the spacer 150 is positioned between the electrode layer 124 and the inner surface 112 of the housing 110 to keep the electrode layer 124 from contact with the housing 110. Furthermore, the spacer 150 can be made of adhesive material, such as double-sided tape to attach the conductive plate 140 and film body 122 together.

Figure 3A:
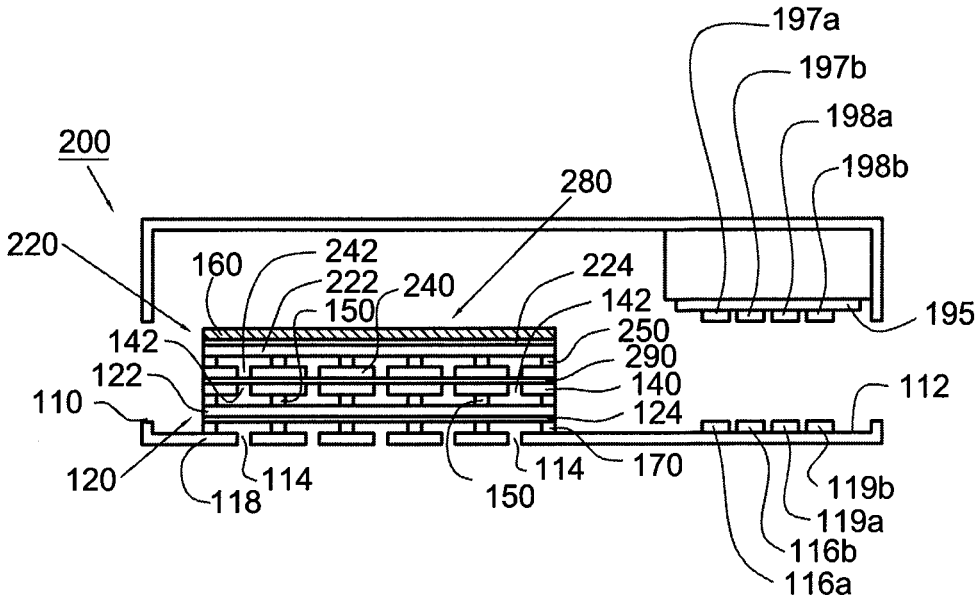
FIG. 3*a* is a cross-sectional view of the electronic device with an electro-acoustic transducer according to the second embodiment of the present invention, wherein the back cover is separated from the body of the electronic device.
Figure 3B:
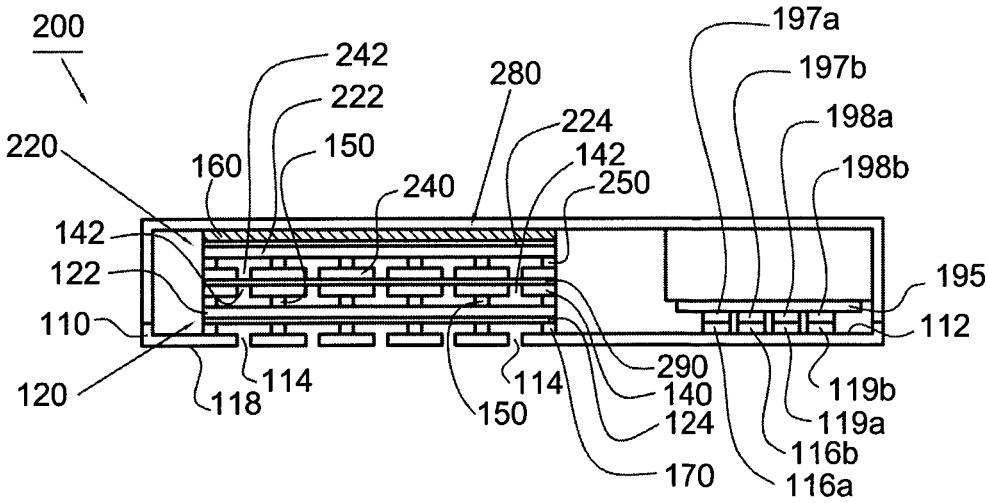
FIG. 3*b* is a cross-sectional view of the electronic device with an electro-acoustic transducer according to the second embodiment of the present invention, wherein the back cover is attached to the body of the electronic device.

Referring to FIGS. 1, 3*a* and 3*b*, the electronic device 200 with an electro-acoustic transducer according to the second embodiment of the present invention has all the elements of the electronic device 100, that is, the housing 110 and the electret diaphragm 120, conductive plate 140, spacers 150, 170 and sound absorbing layer 160 of the electro-acoustic transducer 180. In addition to the above elements, the electro-acoustic transducer 280 of the electronic device 200 further includes a conductive plate 240 functioning as an electrode that is stacked on the conductive plate 140 and has a plurality of openings 242 corresponding to the openings 142 of the conductive plate 140. The conductive plate 240 has a thickness of 0.1 to 1 mm. An isolation layer 290 made of porous air-permeable membrane has a thickness of 20 to 200 μm and is disposed between the conductive plates 140 and 240. In addition, an electret diaphragm 220 is positioned on the conductive plate 240 and includes a film body 222 and an electrode layer 224 formed on the upper surface of the film body 222, wherein the sound absorbing layer 160 is attached to the electrode layer 224. The film body 222 is made of dielectric material and has static charges. The film body 222 has a thickness of 7 to 25 μm and the electrode layer 224 has a thickness of 0.05 to 1 μm. Furthermore, at least one spacer 250 made of, such as adhesive material and corresponding to the spacer 150 is disposed between the electret diaphragm 220 and the conductive plate 240 to keep a predetermined distance between the electret diaphragm 220 and the conductive plate 240. The spacer 250 has a height of 100 to 400 μm.

Similarly, the film body 222 originally without static charges carried thereon is also required to be polarized in order to generate static charges therein and thereon. The material suitable for the film body 222 can be FEP, PTFE, PVDF, silicon dioxide or other fluoride polymers. Furthermore, the edge of the electret diaphragm 220 is also required to be fixed to prevent the electret diaphragm 220 from movement. To have the electro-acoustic transducer 280 of the present embodiment work, a first electrical signal having the same phase with the original sound signal have to be applied to the conductive plate 140 and the electrode layer 224 and a second electrical signal having opposite phase with the original sound signal is applied to the electrode layer 124 and the conductive plate 240. In this manner, the electret diaphragms 120 and 220 will be subject to the Coulomb forces from the conductive plates 140, 240 and electrode layers 124, 224 to vibrate and make sounds in accordance with the first and second electrical signals. The sounds made by the electret diaphragm 220 can travel through the isolation layer 290 and openings 114 to the outside of the housing 110. The electro-acoustic transducer 280 with double electret diaphragms can make double (3 dB) sounds than the electro-acoustic transducer 180 with only a single electret diaphragm.

Figure 4A:
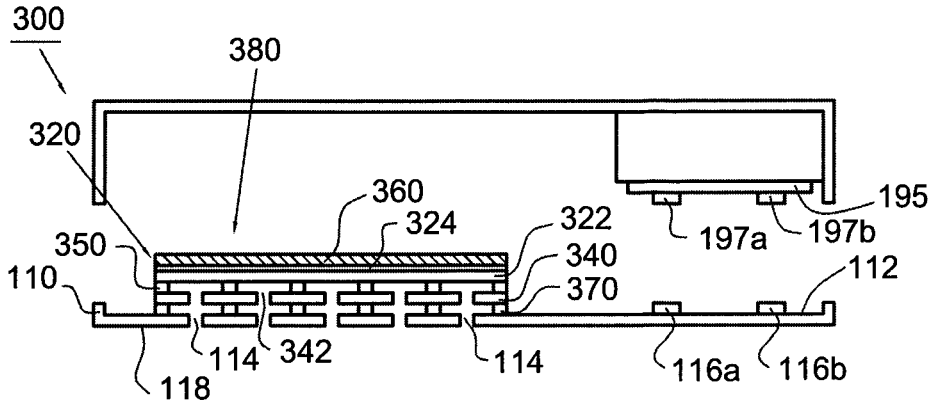
FIG. 4*a* is a cross-sectional view of the electronic device with an electro-acoustic transducer according to the third embodiment of the present invention, wherein the back cover is separated from the body of the electronic device.
Figure 4B:
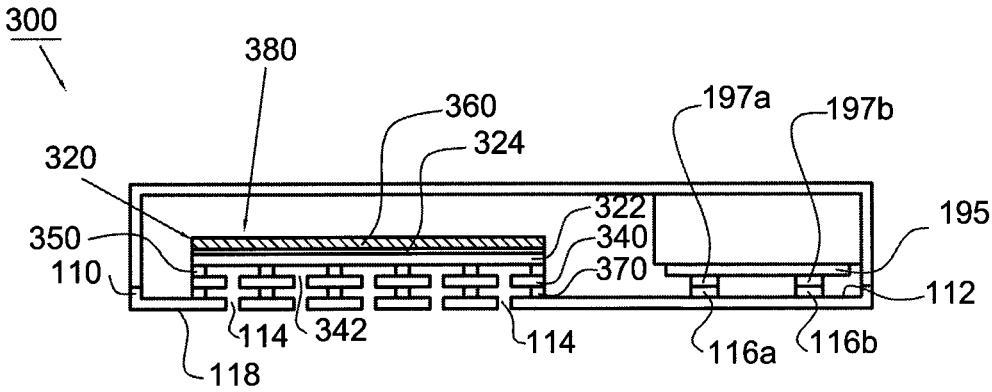
FIG. 4*b* is a cross-sectional view of the electronic device with an electro-acoustic transducer according to the third embodiment of the present invention, wherein the back cover is attached to the body of the electronic device.

Referring to FIGS. 1, 4*a* and 4*b*, the electronic device 300 with an electro-acoustic transducer according to the third embodiment of the present invention includes a housing 110 and an electro-acoustic transducer 380 disposed on the inner surface 112 of the housing 110. The electro-acoustic transducer 380 includes a conductive plate 340 functioning as an electrode disposed on the inner surface 112 of the housing 110. The conductive plate 340 has a plurality of openings 342 corresponding to the openings 114. An electret diaphragm 320 is stacked on the conductive plate 340 and includes a film body 322 and an electrode layer 324 formed on the upper surface of the film body 322. The film body 322 is made of dielectric material and has static charges. The film body 322 has a thickness of 7 to 25 μm and the electrode layer 324 has a thickness of 0.05 to 1 μm. In addition, at least one spacer 350 made of, such as adhesive material is disposed between the electret diaphragm 320 and the conductive plate 340 to keep a predetermined distance between the electret diaphragm 320 and the conductive plate 340. The spacer 350 is spaced 5 to 20 mm apart from each other and has a height of 100 to 400 μm. Moreover, at least one spacer 370 made of, such as adhesive material and corresponding to the spacer 350 is positioned between the conductive plate 340 and the inner surface 112 of the housing 110 to keep the conductive plate 340 from contact with the housing 110. The spacer 370 has a thickness of 30 to 50 μm. Furthermore, a sound absorbing layer 360 is attached to the electrode layer 324 to prevent the echo from degrading the performance of the electro-acoustic transducer 380.

Similarly, the film body 322 originally without static charges carried thereon is also required to be polarized in order to generate static charges therein and thereon. The material suitable for the film body 322 can be FEP, PTFE, PVDF, silicon dioxide or other fluoride polymers. Furthermore, the edge of the electret diaphragm 320 is also required to be fixed to prevent the electret diaphragm 320 from movement. To have the electro-acoustic transducer 380 of the present embodiment work, an electrical signal has to be applied to the conductive plate 340 and electrode layer 324 thereby the electret diaphragm 320 can vibrate to make sounds in accordance with the electrical signal.

Figure 5A:
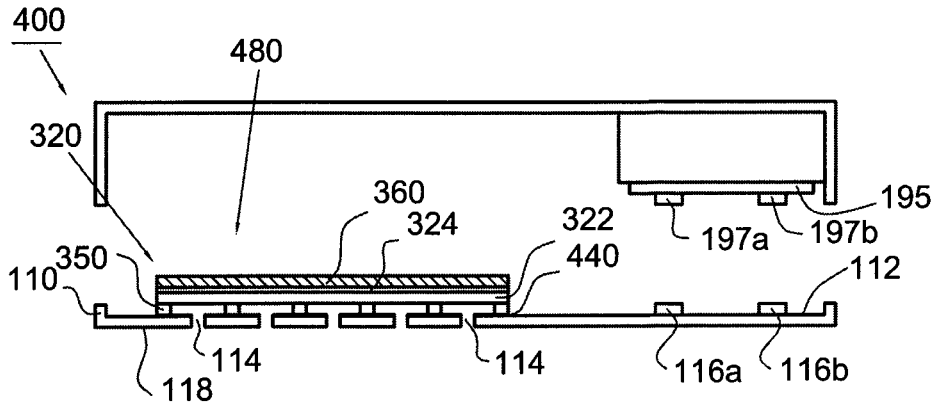
FIG. 5*a* is a cross-sectional view of the electronic device with an electro-acoustic transducer according to the fourth embodiment of the present invention, wherein the back cover is separated from the body of the electronic device.
Figure 5B:
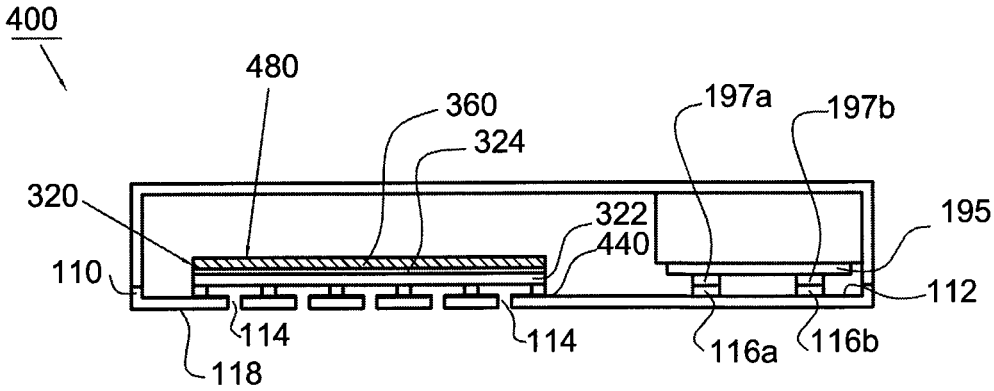
FIG. 5*b* is a cross-sectional view of the electronic device with an electro-acoustic transducer according to the fourth embodiment of the present invention, wherein the back cover is attached to the body of the electronic device.

Referring to FIGS. 1, 5*a* and 5*b*, the electronic device 400 with an electro-acoustic transducer according to the fourth embodiment of the present invention is substantially the same as the electronic device 300 of FIG. 4, where identical reference numerals have been used when designating substantially identically elements that are common to the figures. Any further illustrations of the identical elements are omitted herein. The difference between them is in that the electro-acoustic transducer 480 of the electronic device 400 includes a conductive layer 440 coated on the inner surface 112 of the housing 110 to replace the conductive plate 340 and does not have the spacer 370. Similarly, to have the electro-acoustic transducer 480 of the present embodiment work, an electrical signal has to be applied to the conductive layer 440 and electrode layer 324 thereby the electret diaphragm 320 can vibrate to make sounds in accordance with the electrical signal.

The electro-acoustic transducers 180, 280, 380 and 480 of the electronic devices 100, 200, 300 and 400 are disposed on the housing 110 and the housing 110 can be a front cover, side cover or back cover of the electronic devices 100, 200, 300 and 400. It will be appreciated that the electro-acoustic transducers 180, 280, 380 and 480 have to be electrically connected to other elements, such as circuit boards in the electronic devices 100, 200, 300 and 400 in order to work. Referring back to FIGS. 2*a*, 2*b*, 3*a*, 3*b*, 4*a*, 4*b*, 5*a* and 5*b*, when the electro-acoustic transducers 180, 280, 380 and 480 are mounted on a detachable back covers 110, electrical terminals 116*a* are disposed on the inner surfaces 112 of the back covers 110 to electrically connect to the conductive plates 140, 340 and conductive layer 440, and the electrical terminals 116*b* disposed on the inner surfaces 112 of the hack covers 110 are electrically connected to the electrode layers 124 and 324. In addition, the electrical terminals 119*a* and 119*b* disposed on the inner surface 112 of the back cover 110 of the electronic device 200 are electrically connected to the conductive plate 240 and electrode layer 224 of the electro-acoustic transducer 280, respectively. As shown in FIGS. 2*b*, 3*b*, 4*b* and 5*b*, when the back cover 110 are attached to the body of the electronic devices 100, 200, 300 and 400, the electrical terminals 116*a* and 116*b* are respectively brought into electrical contact with the electrical terminals 197*a* and 197*b* on the circuit boards 195 of the electronic devices 100, 200, 300 and 400, and the electrical terminals 119*a* and 119*b* (shown in FIG. 3*b*) are respectively brought into electrical contact with the electrical terminals 198*a* and 198*b* on the circuit board 195 of the electronic device 200. In this way, the electrical signals can be applied to the conductive plates 140, 240, 340, conductive layer 440 and electrode layers 124, 224, 324 thereby the electret diaphragms 120, 220, 320 can vibrate to make sounds in accordance with the electrical signals.

According to the present invention, the spacers of the electro-acoustic transducers can be discrete spacers. However, it should be understood that the above discrete spacers can be replaced with the sheets formed with a plurality of openings thereon.

The electronic devices of the present invention can be portable electronic devices, such as mobile phones, personal digital assistants (PDAs) or laptop computers. Since the electro-acoustic transducers of the electronic devices according to the present invention have a greatly smaller thickness than the traditional dynamic loudspeakers, the available space inside the electronic device can be increased. In addition, the electro-acoustic transducers of the electronic devices according to the present invention can be mounted on the back covers. Therefore, the thickness of the electronic devices can be further reduced and the available space inside the electronic device can also be further increased. Moreover, since the electret surfaces of the electret diaphragms of the electro-acoustic transducers according to the first and second embodiments of the present invention face the insides of the electronic devices, the electret surfaces therefore get rid of the contamination of the dust and moisture to avoid the malfunction of the electret diaphragms.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An electronic device, comprising:

a housing having an inner surface, an outer surface and a plurality of openings penetrating between the inner surface and the outer surface;

a first electrical terminal and a second electrical terminal disposed on the inner surface of the housing;

a circuit board having a third electrical terminal and a fourth electrical terminal disposed thereon; and an electro-acoustic transducer disposed on the inner surface of the housing and electrically connected to the circuit board, the electro-acoustic transducer comprising:

a first electret diaphragm configured to vibrate and make sounds in accordance with a first electrical signal, the first electret diaphragm being positioned on the inner surface of the housing and having a first film body and a first electrode layer, wherein the first film body includes opposing upper and lower surfaces and has static charges, and the first electrode layer is formed on the lower surface of the first film body;

a first conductive plate stacked on the upper surface of the first film body and having a plurality of openings, wherein the first electrode layer of the first electret diaphragm and the first conductive plate are electrically connected to receive the first electrical signal; and at least one first spacer disposed between the first electret diaphragm and the first conductive plate to keep a predetermined distance between the first electret diaphragm and the first conductive plate;

wherein the third and fourth electrical terminals of circuit board are electrically connected to the first and second electrical terminals, respectively, for applying the first electrical signal to the first electrode layer of the first electret diaphragm and the first conductive plate, respectively.

2. The electronic device as claimed in claim 1, further comprising:

a fifth electrical terminal and a sixth electrical terminal disposed on the inner surface of the housing:

a seventh electrical terminal and an eighth electrical terminal disposed on the circuit board; and wherein the electro-acoustic transducer further comprises:

a second conductive plate stacked on the first conductive plate and having a plurality of opening, wherein the second conductive plate is electrically connected to receive a second electrical signal;

an isolation layer disposed between the first and second conductive plates;

a second electret diaphragm configured to vibrate and make sounds in accordance with the second electrical signal, the second electret diaphragm being stacked on the second conductive plate and having a second film body and a second electrode layer, wherein the second film body includes opposing upper and lower surfaces and has static charges, and the second electrode layer is formed on the upper surface of the second film body and is electrically connected to receive the second electrical signal; and at least one second spacer disposed between the second electret diaphragm and the second conductive plate to keep a predetermined distance between the second electret diaphragm and the second conductive plate;

wherein the seventh and eighth electrical terminals of circuit board are electrically connected to the fifth and sixth electrical terminals, respectively, for applying the second electrical signal to the second electrode layer of the second electret diaphragm and the second conductive plate, respectively.

3. The electronic device as claimed in claim 2, wherein the electro-acoustic transducer further comprises:

a sound absorbing layer attached to the second electrode layer of the second electret diaphragm.

4. The electronic device as claimed in claim 1, wherein the electro-acoustic transducer further comprises:

a sound absorbing layer attached to the first conductive plate.

5. The electronic device as claimed in claim 1, further comprising:

at least one third spacer disposed between the inner surface of the housing and the first electrode layer of the first electret diaphragm to keep a predetermined distance between the first electrode layer of the first electret diaphragm and the inner surface of the housing.

6. The electronic device as claimed in claim 2, further comprising:

at least one third spacer disposed between the inner surface of the housing and the first electrode layer of the first electret diaphragm to keep a predetermined distance between the first electrode layer of the first electret diaphragm and the inner surface of the housing.

7. The electronic device as claimed in claim 1, wherein the first spacer is made of adhesive material.

8. The electronic device as claimed in claim 2, wherein the first and second spacers are made of adhesive material.

9. The electronic device as claimed in claim 3, wherein the sound absorbing layer is made of a material selected from the group consisting of glass fiber, sponge and nonwoven.

10. The electronic device as claimed in claim 4, wherein the sound absorbing layer is made of a material selected from the group consisting of glass fiber, sponge and nonwoven.

11. The electronic device as claimed in claim 1, wherein the first film body of the first electret diaphragm has a thickness of 7 to 25 μm.

12. The electronic device as claimed in claim 1, wherein the first electrode layer of the first electret diaphragm has a thickness of 0.05 to 1 μm.

13. The electronic device as claimed in claim 1, wherein the first conductive plate has a thickness of 0.1 to 1 mm.

14. The electronic device as claimed in claim 1, wherein an aperture ratio of the plurality of openings on the first conductive plate is greater than 20%.

15. The electronic device as claimed in claim 1, wherein the first spacer has a height of 100 to 400 μm.

16. The electronic device as claimed in claim 5, wherein the first spacer has a height of 30 to 50 μm.

17. The electronic device as claimed in claim 3, wherein the sound absorbing layer has a thickness of 1 to 5 mm.

18. The electronic device as claimed in claim 2, wherein the isolation layer is made of porous air-permeable membrane.

19. The electronic device as claimed in claim 18, wherein the isolation layer has a thickness of 20 to 200 μm.

20. An electronic device, comprising:

a housing having an inner surface, an outer surface and a plurality of openings penetrating between the inner surface and the outer surface;

a first electrical terminal and a second electrical terminal disposed on the inner surface of the housing:

a circuit board having a third electrical terminal and a fourth electrical terminal disposed on the circuit board; and an electro-acoustic transducer disposed on the inner surface of the housing and electrically connected to the circuit board, the electro-acoustic transducer comprising:

a conductive plate disposed on the inner surface of the housing and having a plurality of openings, wherein the conductive plate is electrically connected to receive an electrical signal;

an electret diaphragm configured to vibrate and make sounds in accordance with the electrical signal, the electret diaphragm being stacked on the conductive plate and having a film body and an electrode layer, wherein the film body includes opposing upper and lower surfaces and has static charges, and the electrode layer is formed on the upper surface of the film body and is electrically connected to receive the electrical signal; and at least one first spacer disposed between the electret diaphragm and the conductive plate to keep a predetermined distance between the electret diaphragm and the conductive plate;

wherein the third and fourth electrical terminals of circuit board are electrically connected to the first and second electrical terminals, respectively, for applying the electrical signal to the electrode layer of the electret diaphragm and the conductive plate, respectively.

21. The electronic device as claimed in claim 20, wherein the electro-acoustic transducer further comprises:

a sound absorbing layer attached to the electrode layer of the electret diaphragm.

22. The electronic device as claimed in claim 20, further comprising:

at least one second spacer disposed between the inner surface of the housing and the conductive plate to keep a predetermined distance between the conductive plate and the inner surface of the housing.

23. The electronic device as claimed in claim 20, wherein the first spacer is made of adhesive material.

24. An electronic device, comprising:

a housing having an inner surface, an outer surface and a plurality of openings penetrating between the inner surface and the outer surface;

a first electrical terminal and a second electrical terminal disposed on the inner surface of the housing:

a circuit board having a third electrical terminal and a fourth electrical terminal disposed on the circuit board; and an electro-acoustic transducer disposed on the inner surface of the housing and electrically connected to the circuit board, the electro-acoustic transducer comprising:

a conductive layer formed on the inner surface of the housing, wherein the conductive layer is electrically connected to receive an electrical signal;

an electret diaphragm configured to vibrate and make sounds in accordance with the electrical signal, the electret diaphragm being stacked on the conductive layer and having a film body and an electrode layer, wherein the film body includes opposing upper and lower surfaces and has static charges, and the electrode layer is formed on the upper surface of the film body and is electrically connected to receive the electrical signal; and at least one spacer disposed between the electret diaphragm and the conductive layer to keep a predetermined distance between the electret diaphragm and the conductive layer;

wherein the third and fourth electrical terminals of circuit hoard are electrically connected to the first and second electrical terminals, respectively, for applying the electrical signal to the electrode layer of the electret diaphragm and the conductive layer, respectively.

25. The electronic device as claimed in claim 24, wherein the electro-acoustic transducer further comprises:

a sound absorbing layer attached to the electrode layer of the electret diaphragm.

26. The electronic device as claimed in claim 24, wherein the first spacer is made of adhesive material.

27. The electronic device as claimed in claim 1, wherein the third and fourth electrical terminals are in detachable electrical contact with the first and second electrical terminals.

28. The electronic device as claimed in claim 1, wherein the housing is a cover, the electronic device further comprising:

a body, wherein the circuit board is attached to the body, wherein the third and fourth electrical terminals are brought into electrical contact with the first and second electrical terminals, respectively, when the cover is attached to the body.

29. The electronic device as claimed in claim 20, wherein the third and fourth electrical terminals are in detachable electrical contact with the first and second electrical terminals.

30. The electronic device as claimed in claim 24, wherein the third and fourth electrical terminals are in detachable electrical contact with the first and second electrical terminals.

* * * * *